US006015771A

United States Patent [19]

Fisher et al.

[11] Patent Number: 6,015,771

[45] Date of Patent: Jan. 18, 2000

[54] THERMALLY-RESPONSIVE RECORD MATERIAL

[75] Inventors: Mark Robert Fisher, Appleton; John Charles DeBraal, Kaukauna, both of Wis.; Guido Steffan, Odenthal; Peter P. Wenzl, Cologne, both of Germany

[73] Assignee: Bayer Aktiengesellschaft, Leverkusen, Germany

[21] Appl. No.: 09/083,807

[22] Filed: May 22, 1998

[51] Int. Cl.[7] ..... B41M 5/30

[52] U.S. Cl. ..... 503/209; 503/200; 503/208; 503/216; 503/225; 503/226

[58] Field of Search ..... 503/200, 208, 503/209, 216, 225, 226

[56] References Cited

U.S. PATENT DOCUMENTS

| | | | |
|---|---|---|---|
| 4,095,034 | 6/1978 | Mangold et al. | 560/134 |
| 4,258,201 | 3/1981 | Moy | 560/24 |
| 4,260,781 | 4/1981 | Harvey | 560/24 |
| 4,301,087 | 11/1981 | Greene | 260/463 |
| 4,443,621 | 4/1984 | LaMattina et al. | 560/142 |
| 5,312,796 | 5/1994 | Nishimura et al. | 503/209 |

FOREIGN PATENT DOCUMENTS 2334262 1/1974 Germany .

2702372 7/1978 Germany .

OTHER PUBLICATIONS

Mechanisms of Color Formation on Thermo–Sensitive Paper by Akira Igarashi and Teppei Ikeda, Scientific Publications of the Fuji Photo Film, Ltd. No. 29,97.

*Primary Examiner*—Bruce H. Hess
*Attorney, Agent, or Firm*—Joseph C. Gil; Diderico van Eyl

[57] ABSTRACT

The present invention discloses a novel thermally-responsive record material having coated thereon a thermally sensitive color forming composition comprising a chromogenic material, an acidic developer material and a carbamate of the formula

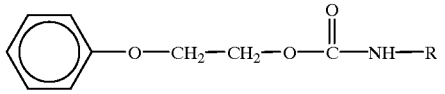

wherein R is selected from alkyl, aryl or aralkyl. The alkyl moiety in each of the preceding is selected to be of from one to eight carbons. The novel record material displays enhanced image intensity or improved thermal response.

17 Claims, No Drawings

THERMALLY-RESPONSIVE RECORD MATERIAL

FIELD OF THE INVENTION

This invention relates to a thermally-responsive record material. It more particularly relates to such record material in the form of sheets coated with color-forming systems comprising chromogenic material (electron-donating dye precursors) and acidic color developer material. This invention particularly concerns a thermally-responsive record material (thermal record material) capable of forming a substantially non-reversible image with improved color-forming efficiency and/or image density.

DESCRIPTION OF RELATED ART

Thermally-responsive record material systems are well known in the art and are described in many patents, for example: U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a color image upon selective thermal exposure.

In the field of thermally-responsive record material, thermal response is defined as the temperature at which a thermally-responsive record material produces a colored image of sufficient intensity (density). The desired temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

The ability of a thermally-responsive record material to have improved imaging characteristics such as enhanced image intensity, image density, or improved thermal response, would be an advance in the art and of commercial significance.

SUMMARY OF THE INVENTION

The present invention is a novel thermally-responsive record material having coated thereon, in substantially contiguous relationship, a thermally-sensitive color-forming composition comprising a chromogenic material, an acidic developer material whereby the melting or sublimination of either material produces a change in color reaction, and a compound of the formula:

(I)

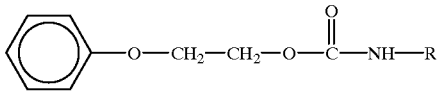

wherein R is selected from aryl, alkyl, and aralkyl. The alkyl moiety in each of the preceding is selected to be of from one to eight carbons.

The compounds useful in the invention can be named as carbamates, but can also be named as carbonyl amines or in some literature, are also referred to as phenoxyethoxy derivatives.

The thermally-responsive record material of the invention comprises a substrate bearing a thermally-sensitive color-forming composition coated on the substrate in one or more layers. The thermally-sensitive color-forming composition comprises an electron-donating dye precursor and an acidic developer material. The reactive color-forming composition constituents are in contiguous relationship, whereby the melting or sublimination of either material produces a change in color reaction. The novel thermally-responsive record material includes in addition a compound of the formula:

(I)

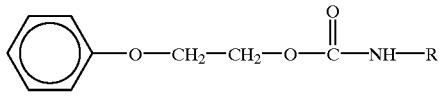

and a suitable binder. (R is an aryl, alkyl, or an aralkyl group wherein the alkyl moiety is of from one to eight carbons).

DETAILED DESCRIPTION

Description of Preferred Embodiments

The present invention is a novel thermally-responsive record material comprising a substrate bearing a thermally-sensitive color-forming composition comprising an electron-donating dye precursor and an acidic developer material in contiguous relationship, whereby the melting or sublimation of either material produces a change in color by reaction between the two, and a carbamate of the formula (I)

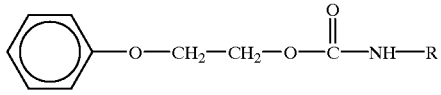

Specific examples of the carbamates (which can also be named as carbonyl amines) include:

2-phenoxyethyl-N-phenylcarbamate. This material can also be named as N-phenyl-N-(2-phenoxyethoxycarbonyl) amine

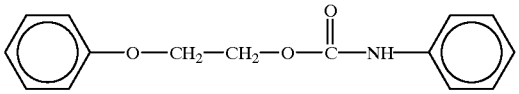

N-(4-ethylphenyl)-N-(2-phenoxyethoxycarbonyl) amine

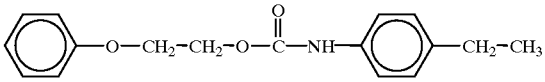

N-(4-methylphenyl)-N-(2-phenoxyethoxycarbonyl) amine

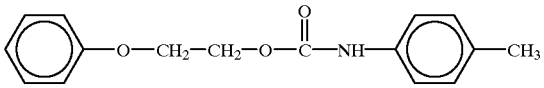

N-ethyl-N-(2-phenoxyethoxycarbonyl) amine

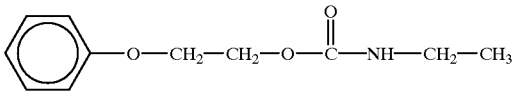

N-methyl-N-(2-phenoxyethoxycarbonyl) amine

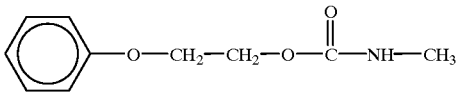

N-propyl-N-(2-phenoxyethoxycarbonyl) amine

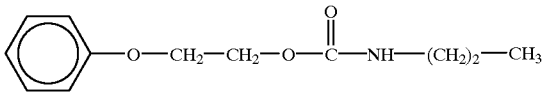

N-octyl-N-(2-phenoxyethoxycarbonyl) amine

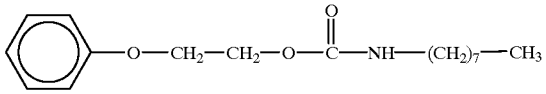

Preferred among the carbamate compounds of this invention is:

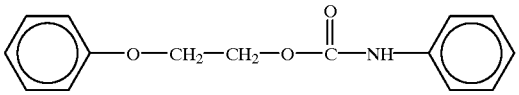

The carbamates of the invention desirably function as a sensitizer facilitating reaction between the mark-forming components yielding a more intense image at lowered temperatures or faster imaging. The thermally-responsive record material of the invention has the surprising property of being capable of forming a stable non-reversible high density image upon thermal contact at lower thermal energies.

While the carbamate used in the invention is a known material it has heretofore not found use in the thermal record material industry. Suprisingly the material according to the invention has remarkable properties beneficial to manufacture of improved thermal record material. Carbamate according to formula I is commercially available from chemical specialty manufacturers such as Bayer Chemical Company, alternatively would be able to be synthesized by one skilled in the art.

Carbamates according to the invention can be synthesized by reacting a corresponding carbamyl compound with a corresponding hydroxy compound at a temperature near the decomposition temperature of the carbamyl chloride in mono or poly-substituted alkyl or halo-benzene as solvent. These and other synthetic processes are described in the literature including in such patents as U.S. Pat. Nos. 4,095,034; 4,443,622; 4,301,087; 4,258,201; and 4,260,781 incorporated herein by reference.

Other synthetic routes would be apparent to the artisan having skill in the synthetic arts. The invention resides in the surprising combination of this material within a thermally imaging record material.

The invention comprises a thermally sensitive color-forming composition comprising electron donating dye precursor (chromogenic material) and acidic developer material, a carbamate of formula I and binder material. The unexpected feature of this composition is that the inclusion of the compound of formula I facilitates the color-forming reaction resulting in a more intense image or faster imaging by image formation at lower temperature. The record material according to the invention has a non-reversible image in that it is substantially non-reversible under the action of heat. The coating of the record material of the invention is basically a dewatered solid at ambient temperature and differs from reversible solvent liquid based compositions such as taught by Kito et al., in U.S. Pat. Nos. 4,720,301 and 4,732,810 which erase upon exposure to elevated temperature from 20° C. to 50° C. The image herein formed is non-reversible at such temperature. The color-forming composition (or system) of the record material of this invention comprises chromogenic material (electron-donating dye precursor) in its substantially colorless state, acidic developer material such as, for example, phenolic compounds. The color-forming system relies upon melting, softening, or subliming one or more of the components to achieve reactive, color-producing contact.

The record material includes a substrate or support material which is generally in sheet form. For purposes of this invention, sheets can be referred to as support members and are understood to also means webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in a substantially contiguous relationship, substantially homogeneously distributed throughout the coated layer or layers of material deposited on the substrate.

The term substantially contiguous relationship is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components, or the carbamate or acidic developer, positioned in a subsequent layer or layers. The coating can optionally be applied to all of the substrate or spot printed on a certain portion. All such arrangements are understood herein as being substantially contiguous.

The thermal record material can optionally include a variety of precoats such as a base layer of clay, and absorptive pigments such as kaolin clays, insulators such as hollow sphere particles, pigments, particulate clays, starch, or synthetic polymeric materials. Hollow sphere particles are commercially available such as the "Ropaque" materials of Rohm and Haas.

Optionally, the thermally-sensitive color-forming composition can be formed as a top layer on the substrate which top layer is then overcoated with a protective layer or barrier layer formed from one or more water soluble or dispersible polymeric materials such as polyvinyl alcohol, carboxylated polyvinyl alcohol, methyl or ethyl cellulose, polyacrylamide, gelatin, starch or polyvinyl pyrrolidone.

Optionally, a protective layer using the same or different materials can be applied as a back coat to the thermally-sensitive record material. Materials useful as precoats, such as the hollow sphere particles, pigments, clays and synthetic polymeric particulate materials can also be usefully included in the back coat. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents; defoamers, and antioxidants. Other sensitizers can also be included. These sensitizers for example, can include acetoacet-o-toluidine, phenyl-1-hydroxy-2-naphthoate, 1,2-diphenoxyethane, and p-benzylbiphenyl.

The color-forming system components are substantially insoluble in the dispersion vehicle (preferably water) and are ground to an individual average particle size of between about 1 micron to about 10 microns, preferably about 1–3 microns. The polymeric binder material is substantially vehicle soluble although latexes are also eligible in some instances. Preferred water soluble binders include polyvinyl alcohol, hydroxy ethyl-cellulose, methylcellulose, methylhydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible election-donating dye precursors are chromogenic material. Chromogenic materials such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. RE 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, the U.S. Pat. Nos. 3,624,107; 3,627,78; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-flouran (U.S. Pat. No. 4,510,513) also known as 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spirodi-[2H-1-benzopyran] and mixtures of any of the following.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis (4-hydroxyphenyl)pentanoate; methyl-4,4-bis (4-hydroxyphenyl) pentanoate; alkyl-4,4-bis(4-hydroxyphenyl) pentanoate; 3,3-bis (4-hydroxyphenyl)-pentane; 4,4-bis (4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol, ethyl-4,4-bis(4-hydroxyphenyl)-pentanoate, n-propyle-4,4-bis(4-hydroxyphenyl)pentanoate, isopropyl-4,4-bis (4-hydroxyphenyl) pentanoate, methyl 4,4-bis(4-hydroxyphenyl) pentanoate, 2,2-bis (4-hydroxyphenyl)-4-methylpentane, p-hydroxybenzophenone, 2,4-dihydroxybenzophenone, 1,1-bis(4-hydroxyphenyl) cyclohexane, and benzyl-p-hydroxybenzoate. Acid compounds of other kind and types are eligible.

Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, aftapulgite, hallosyte, and the like. Some of the polymers and minerals do not melt but undergo color reaction on fusion of the chromogen.

The following examples are given to illustrate some of the features of the present and should not be considered as limiting. In these examples all parts or proportions are by weight and all measurements are in the metric system, unless otherwise stated.

In all examples illustrated in the present invention, a dispersion of a particular system component, was prepared by milling the component in an aqueous solution of the binder until a particle size of between about 1 micron and 10 microns was achieved. The milling was accomplished in an attritor or other suitable milling device. The desired average particle size was about 1–3 microns in each dispersion. Although the examples illustrate the invention using 2,2-bis (4-hydroxyphenyl)-4-methylpentane, 4-hydroxy-4'-isopropoxy diphenylsulfone, or bis (4-hydroxy-3-allylphenyl)sulfone as the acidic developer material, the invention is readily practiced using any of the eligible acidic developer materials listed above.

The thermally-responsive sheets were made by making separate dispersions of chromogenic material, acidic material and the compound of formula 1. The dispersions were mixed in the desired ratios and applied to a support with a wire wound rod and dried. Other materials such as fillers, antioxidants, lubricants and waxes can be added if desired. The sheets may be calendered to improve smoothness.

| | Parts |
|---|---|
| Dispersion A - Chromogenic Material | |
| Chromogenic Material | 32.0 |
| Binder, 20% solution of Polyvinyl alcohol in water | 27.4 |
| Defoaming and dispersing agents | 0.4 |
| Water | 40.2 |
| Dispersion A1 - Chromogenic Material is N102t | |
| 3-Diethyamino-6-methyl-7-anilinofluoran | |
| Dispersion A2 - Chromogenic Material is ODB-2 | |
| 3-Dibutylamino-6-methyl-7-anilinofluoran | |
| Dispersion A3 - Chromogenic Material is black 305 | |
| 3-Dipentylamino-6-methyl-7-anilinofluoran | |
| Dispersion B - Acidic Material | |

-continued

| | Parts |
|---|---|
| Acidic Material | 42.5 |
| Binder, 20% solution of Polyvinyl alcohol in water | 21.2 |
| Defoaming and dispersing agents | 0.2 |
| Water | 36.1 |
| Dispersion B1 - Acidic Material is AP-5 | |
| 2,2-Bis(4-hydroxyphenyl)-4-methylpentane | |
| Dispersion B2 - Acidic Material is D8 | |
| 4-Hydroxy-4'-isopropoxy diphenyl sulfone | |
| Dispersion B3 - Acidic Material is TGSA | |
| Bis(4-hydroxy-3-allylphenyl)sulphone | |
| Dispersion C - Sensitizing Material | |
| Sensitizing Material | 42.5 |
| Binder, 20% solution of Polyvinyl alcohol in water | 21.2 |
| Defoaming and dispersing agents | 0.2 |
| Water | 36.1 |
| Dispersion C1 - Sensitizing Material is PPC | |
| 2-Phenoxyethyl-N-Phenylcarbamate | |
| Dispersion C2 - Sensitizing Material is PMC | |
| 2-Phenoxyethyl-N-Methylcarbamate | |
| Coating Formulation 1 | |
| Dispersion A (Chromogenic) | 7.6 |
| Dispersion B (Acidic) | 15.0 |
| Dispersion C (Sensitizing) | 15.0 |
| Binder, 10% solution of polyvinylalcohol in water | 45.5 |
| Filler slurry, 50% in water | 19.0 |

EXAMPLE 1

Coating Formulation 1 Using
Dispersion A1 (N102t)
Dispersion B1 (AP-5)
Dispersion C1 (PPC)

EXAMPLE 2

Coating Formulation 1 Using
Dispersion A2 (ODB-2)
Dispersion B1 (AP-5)
Dispersion C1 (PPC)

EXAMPLE 3

Coating Formulation 1 Using
Dispersion A3 (Black 305)
Dispersion B1 (AP-5)
Dispersion C2 (PMC)

EXAMPLE 4

Coating Formulation 1 Using
Dispersion A2 (ODB-2)
Dispersion B1 (AP-5)
Dispersion C2 (PMC)

EXAMPLE 5

Coating Formulation 1 Using
Dispersion A1 (N102t)
Dispersion B2 (D8)
Dispersion C1 (PPC)

EXAMPLE 6

Coating Formulation 1 Using
Dispersion A2 (ODB-2)
Dispersion B2 (D8)
Dispersion C1 (PPC)

-continued

| | Parts |
|---|---|
| EXAMPLE 7 | |
| Coating Formulation 1 Using | |
| Dispersion A3 (Black 305) | |
| Dispersion B2 (D8) | |
| Dispersion C2 (PMC) | |
| EXAMPLE 8 | |
| Coating Formulation 1 Using | |
| Dispersion A2 (ODB-2) | |
| Dispersion B2 (D8) | |
| Dispersion C2 (PMC) | |
| EXAMPLE 9 | |
| Coating Formulation 1 Using | |
| Dispersion A1 (N102t) | |
| Dispersion B3 (TGSA) | |
| Dispersion C1 (PPC) | |
| EXAMPLE 10 | |
| Coating Formulation 1 Using | |
| Dispersion A3 (Black 305) | |
| Dispersion B3 (TGSA) | |
| Dispersion C2 (PMC) | |
| EXAMPLE 11 | |
| Coating Formulation 1 Using | |
| Dispersion A2 (ODB-2) | |
| Dispersion B3 (TGSA) | |
| Dispersion C2 (PPC) | |
| Coating Formulation 2 | |
| Dispersion A (Chromogenic) | 7.6 |
| Dispersion B (Acidic) | 15.0 |
| Dispersion C (Sensitizing) | 0.0 |
| Binder, 10% solution of polyvinylalcohol in water | 45.5 |
| Filler slurry, 50% in water | 19.0 |
| COMPARATIVE EXAMPLE 12 | |
| Coating Formulation 2 Using | |
| Dispersion A1 (N102t) | |
| Dispersion B1 (AP-5) | |
| COMPARATIVE EXAMPLE 13 | |
| Coating Formulation 2 Using | |
| Dispersion A2 (ODB-2) | |
| Dispersion B1 (AP-5) | |
| COMPARATIVE EXAMPLE 14 | |
| Coating Formulation 2 Using | |
| Dispersion A3 (BLACK-305) | |
| Dispersion B1 (AP-5) | |

-continued

| | Parts |
|---|---|
| COMPARATIVE EXAMPLE 15 | |
| Coating Formulation 2 Using | |
| Dispersion A1 (N102t) | |
| Dispersion B2 (D8) | |
| COMPARATIVE EXAMPLE 16 | |
| Coating Formulation 2 Using | |
| Dispersion A2 (ODB-2) | |
| Dispersion B2 (D8) | |
| COMPARATIVE EXAMPLE 17 | |
| Coating Formulation 2 Using | |
| Dispersion A3 (BLACK-305) | |
| Dispersion B2 (D8) | |
| COMPARATIVE EXAMPLE 18 | |
| Coating Formulation 2 Using | |
| Dispersion A1 (N102t) | |
| Dispersion B3 (TGSA) | |
| COMPARATIVE EXAMPLE 19 | |
| Coating Formulation 2 Using | |
| Dispersion A2 (ODB-2) | |
| Dispersion B3 (TGSA) | |
| COMPARATIVE EXAMPLE 20 | |
| Coating Formulation 2 Using | |
| Dispersion A3 (BLACK-305) | |
| Dispersion B3 (TGSA) | |

The examples were coated at 3.0 gm/m$^2$ The examples were then printed on the ATLANTEK model 300. The optical density was measured using a MacBeth II densitometer. The results are shown in Table 1. Imaged on an Atlantek Model 300. Optical Density of the image formed was read using a MacBeth Answer II densitometer.

TABLE 1

| mJ/mm$^2$ | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| 10.449 | 0.11 | 0.08 | 0.10 | 0.12 | 0.16 | 0.07 | 0.15 | 0.16 | 0.28 | 0.27 | 0.24 |
| 12.000 | 0.32 | 0.26 | 0.49 | 0.43 | 0.40 | 0.14 | 0.55 | 0.67 | 0.54 | 0.67 | 0.86 |
| 15.224 | 0.49 | 0.39 | 0.61 | 0.71 | 0.64 | 0.32 | 0.91 | 0.97 | 0.77 | 0.98 | 1.11 |
| 17.755 | 0.67 | 9.55 | 0.85 | 0.85 | 0.76 | 0.46 | 1.06 | 1.18 | 0.81 | 1.11 | 1.31 |
| 19.592 | 0.81 | 0.60 | 1.08 | 1.04 | 0.91 | 0.63 | 1.22 | 1.35 | 0.93 | 1.26 | 1.31 |
| 21.265 | 0.99 | 0.77 | 1.17 | 1.15 | 1.04 | 0.78 | 1.33 | 1.43 | 1.00 | 1.36 | 1.43 |
| 25.184 | 1.01 | 0.91 | 1.19 | 1.34 | 1.16 | 0.89 | 1.36 | 1.44 | 1.08 | 1.44 | 1.47 |
| 28.571 | 1.20 | 0.92 | 1.21 | 1.35 | 1.22 | 6.97 | 1.41 | 1.44 | 1.10 | 1.43 | 1.48 |
| 31.837 | 1.28 | 1.06 | 1.45 | 1.41 | 1.28 | 1.11 | 1.42 | 1.44 | 1.22 | 1.48 | 1.47 |
| 37.551 | 1.40 | 1.24 | 1.46 | 1.45 | 1.40 | 1.35 | 1.43 | 1.45 | 1.38 | 1.50 | 1.48 |

| | Comparative Examples | | | | | | | | |
|---|---|---|---|---|---|---|---|---|---|
| mJ/mm$^2$ | Comp. Ex. 12 | Comp. Ex. 13 | Comp. Ex. 14 | Comp. Ex. 15 | Comp. Ex. 16 | Comp. Ex. 17 | Comp. Ex. 18 | Comp. Ex. 19 | Comp. Ex. 20 |
| 10.45 | 0.08 | 0.07 | 0.08 | 0.09 | 0.06 | 0.09 | 0.20 | 0.14 | 0.12 |
| 12.00 | 0.12 | 0.07 | 0.21 | 0.18 | 0.10 | 0.31 | 0.29 | 0.43 | 0.35 |
| 15.22 | 0.20 | 0.14 | 0.42 | 0.34 | 0.24 | 0.54 | 0.38 | 0.63 | 0.56 |
| 17.76 | 0.31 | 0.25 | 0.58 | 0.50 | 0.34 | 0.75 | 0.54 | 0.77 | 0.75 |
| 19.59 | 0.42 | 0.27 | 0.82 | 0.65 | 0.45 | 0.98 | 0.64 | 0.99 | 0.94 |
| 21.27 | 0.49 | 0.43 | 0.99 | 0.85 | 0.65 | 1.14 | 0.83 | 1.20 | 1.10 |
| 25.18 | 0.62 | 0.50 | 1.10 | 1.00 | 0.72 | 1.27 | 0.92 | 1.22 | 1.19 |
| 28.57 | 0.63 | 0.62 | 1.16 | 1.12 | 0.80 | 1.34 | 0.97 | 1.30 | 1.26 |
| 31.84 | 0.78 | 0.86 | 1.28 | 1.27 | 1.06 | 1.38 | 1.06 | 1.34 | 1.40 |
| 37.55 | 0.85 | 1.15 | 1.46 | 1.37 | 1.35 | 1.49 | 1.35 | 1.50 | 1.49 |

The results in the table demonstrate that the record material of the invention with the carbamate compound has improved thermal response and/or more intense or faster imaging than record systems without the material.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

We claim:

1. A thermally-responsive record material comprising a support having provided thereon in substantially contiguous relationship a chromogenic material, an acidic developer material, a carbamate of the formula

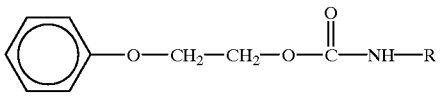

wherein R is selected from alkyl, aryl and aralkyl, said alkyl moiety being from one to eight carbons, and a suitable binder therefore.

2. The thermally-responsive record material according to claim 1 wherein the carbamate is

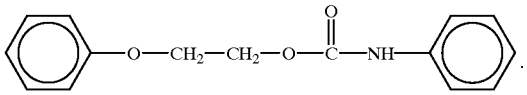

3. The thermally-responsive record material according to claim 1 wherein the chromogenic material is a fluoran compound, the acidic developer is a phenolic resin and the carbamate compound is

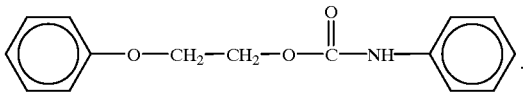

4. The thermally-responsive record material according to claim 1 including in addition a precoat on the support comprising hollow sphere particles.

5. The thermally-responsive record material according to claim 1 wherein the thermally-responsive record material includes in addition a precoat and a top-coat.

6. The thermally-responsive record material according to claim 5 wherein the top coat is a polymeric material selected from polyvinyl alcohol and carboxylated polyvinyl alcohol.

7. The thermally-responsive record material according to claim 5 wherein the record material in addition includes a back coat.

8. Thermally-responsive record material according to claim 7 wherein the back coat comprises hollow sphere particles.

9. The thermally-responsive record material according to claim 1 wherein the carbamate is

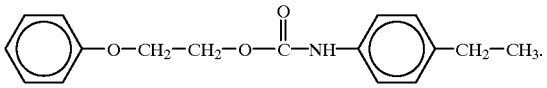

10. The thermally-responsive record material according to claim 1 wherein the carbamate is

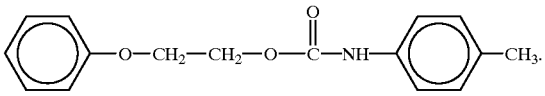

11. The thermally-responsive record material according to claim 1 wherein the carbamate is

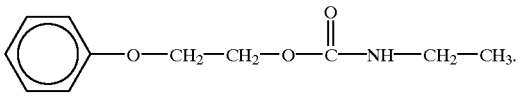

12. The thermally-responsive record material according to claim 1 wherein the carbamate is

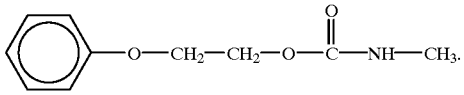

13. The thermally-responsive record material according to claim 1 wherein the carbamate is

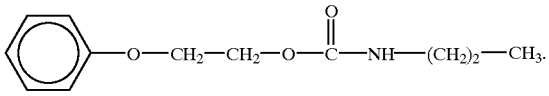

14. The thermally-responsive record material according to claim 1 wherein the carbamate is

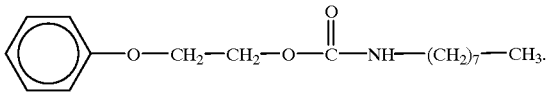

15. The thermally-responsive record material according to claim 1 wherein the carbamate is

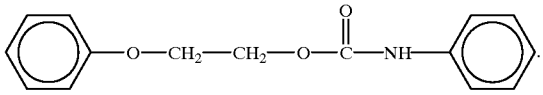

16. The thermally-responsive record material according to claim 15 wherein the record material in addition includes a back coat.

17. A thermally-responsive record material comprising a support having coated thereon in one or more layers a chromogenic material, an acidic developer material and N-phenyl-N-(2-phenoxyethoxycarbonyl) amine.

* * * * *